United States Patent [19]

Slat et al.

[11] Patent Number: 4,733,804

[45] Date of Patent: Mar. 29, 1988

[54] LIQUID DISPENSING CONTAINER HAVING RIBBED CONSTRUCTION

[75] Inventors: William A. Slat, Brooklyn, Mich.; Richard C. Darr, Seville, Ohio

[73] Assignee: Plastipak Packaging, Inc., Plymouth, Mich.

[21] Appl. No.: 909,872

[22] Filed: Sep. 22, 1986

[51] Int. Cl.[4] ..... B65D 1/42; B65D 1/46

[52] U.S. Cl. ..... 222/465.1; 222/481; 220/72

[58] Field of Search ..... 222/465 R, 468, 475, 222/478, 481, 482, 511; 220/72; D9/411, 395–397, 409, 350–351; 215/1 C

[56] References Cited

U.S. PATENT DOCUMENTS

| | | | |
|---|---|---|---|
| D. 258,346 | 2/1981 | Winchell et al. | D9/409 X |
| D. 269,948 | 8/1983 | Janssen | D9/409 X |
| D. 287,937 | 1/1987 | Sargent et al. | D9/409 X |
| 4,372,455 | 2/1983 | Cochran | 220/72 X |
| 4,579,260 | 4/1986 | Young et al. | 222/465.1 |

*Primary Examiner*—Joseph J. Rolla
*Assistant Examiner*—Nils E. Pedersen
*Attorney, Agent, or Firm*—Brooks & Kushman

[57] ABSTRACT

A plastic blow molded container (20) for holding liquids includes a rectangular body portion (22) having at least one rib (44,46) extending completely around the container and having a construction that facilitates assembly of a unitary valve (42) to a dispensing spout (40) while maintaining flatness of side walls of the container during use. Each rib (44,46) has curved rib portions (48) extending along a pair of longer side walls (28). Each rib also has a relatively shallow rib portion (50) adjacent one shorter side wall (30) to prevent excessive compression thereof as the unitary valve (42) is pressed onto the dispensing spout (40). Each rib also has a relatively deep rib portion (52) along another shorter side wall (32) to maintain its flatness with the container filled and supported on the one shorter side wall (30) for the liquid dispensing through the valve (42). A top closure (38) of the container in addition to including the dispensing spout (40) includes a central handle (70) and a vent hump (72) having a label surface (74) that is inclined at about forty-five degrees with a vent (76) at its lower extremity to facilitate the liquid dispensing by admitting air into the container.

8 Claims, 9 Drawing Figures

LIQUID DISPENSING CONTAINER HAVING RIBBED CONSTRUCTION

TECHNICAL FIELD

This invention relates to a plastic blow molded container for holding liquids and having a ribbed construction as well as a unitary valve that provide the container with particular utility for dispensing spring or distilled water although other uses are also possible.

BACKGROUND ART

Plastic blow molded containers have previously been utilized to hold liquids such as spring, distilled, or tap water, etc. When utilized to hold water for drinking purposes, such containers have previously included valves for dispensing the water. Dispensing valves previously utilized with such containers have conventionally been of a multiple piece construction that is not particularly economical. See, for example, U.S. Pat. Nos. 3,430,824 and 3,497,146. Also, plastic blow molded containers for drinking water have previously utilized an upper handle and a bottom valve as shown by U.S. Pat. No. Des. 224,639. Any liquid leakage with this type of bottom valve container presents a problem since the valve is exposed to water until substantially the entire contents of the container have been emptied. All of the containers disclosed by the above referenced patents have an inclined spout which is necessary with the multiple piece valve constructions utilized to provide dispensing of drinking water. However, such inclined spouts require that the container be supported in an inclined orientation upon filling which is much more difficult to accomplish than with the containers supported straight up.

U.S. Pat. Nos. 3,440,866 and 3,443,728 disclose a unitary dispensing valve utilized with a bag liner that is positioned within a box with the valve projecting outwardly therefrom to provide dispensing of liquid within the lined box. This type of bag liner within a box utilizing the unitary dispensing valve has been previously utilized commercially for dispensing of wine.

U.S. Pat. No. 4,579,260 discloses a plastic blow molded container having a unitary dispensing valve that is utilized to dispense liquid contents of the container. The container includes a body portion having a closed bottom end and a top closure at which the unitary dispensing valve is located adjacent one side of a central handle on whose other side a vent hump is located. A pair of upper and lower ribs extend around the body portion of the container to increase its mechanical strength.

DISCLOSURE OF INVENTION

An object of the present invention is to provide an improved blow molded container having a unitary dispensing valve and a ribbed construction that prevents side walls of the filled container from bulging when used to provide dispensing while still permitting the unitary dispensing valve to be pressed onto a dispensing spout without excessive compression that makes the attachment of the unitary dispensing valve more difficult.

In carrying out the above object, a plastic blow molded container for holding liquids in accordance with the invention has a hollow body portion with bottom and top ends. This body portion of the container has first and second pairs of generally flat side walls extending between its bottom and top ends. One of the pairs of side walls has a longer horizontal extent than the other pair to provide the body portion with a horizontally elongated rectangular shape between its bottom and top ends. A bottom wall of the container closes the bottom end of the body portion, while a top closure closes the top end of the body portion and has a dispensing spout located adjacent one of the shorter side walls in a remote relationship with respect to the other shorter side wall. At least one rib is provided extending completely around the body portion of the container and projecting inwardly toward its interior. Curved rib portions of the rib are located along the pair of longer side walls to maintain the flatness thereof when the container is filled with liquid. The rib has a relatively shallow rib portion along the one shorter side wall adjacent the dispensing spout to prevent excessive compression thereof as the unitary valve is pressed onto the dispensing spout for attachment. The rib also has a relatively deep rib portion along the other shorter side wall to maintain the flatness thereof with the filled container supported on the one shorter side wall for the liquid dispensing through the unitary valve. The relatively shallow and deep rib portions along the two shorter side walls thus facilitate the assembly of the unitary valve by preventing compression of the one shorter side wall as the valve is pressed onto the dispensing spout and also prevent the other shorter side wall from deflecting from its flat shape which would result if a shallower rib portion were utilized like the shallow rib portion on the one shorter side wall adjacent the dispensing valve.

In the preferred construction, the top closure includes a central handle located midway between both pairs of side walls and the dispensing spout is located on one side of the central handle toward the one shorter side wall with the relatively shallow rib portion. The top closure also has a vent hump that supports the handle on the side thereof toward the other shorter side wall. This vent hump has a label surface that extends downwardly from the handle at an inclination of about forty-five degrees and has a vent at its lower extremity adjacent the junction of the label surface with the shorter container side wall having the deep rib portion.

The body portion of the container most preferably includes a pair of the ribs extending around the side walls thereof at upper and lower locations with respect to each other. Each rib includes inclined rib walls that converge toward each other in an inward direction and each rib also includes a vertical connecting rib wall that connects its inclined rib walls. The inclined rib walls along the shorter side wall adjacent the dispensing spout are shorter than the inclined rib walls along the other side wall to thereby provide the difference in the depths of the rib portions along the pair of shorter side walls.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
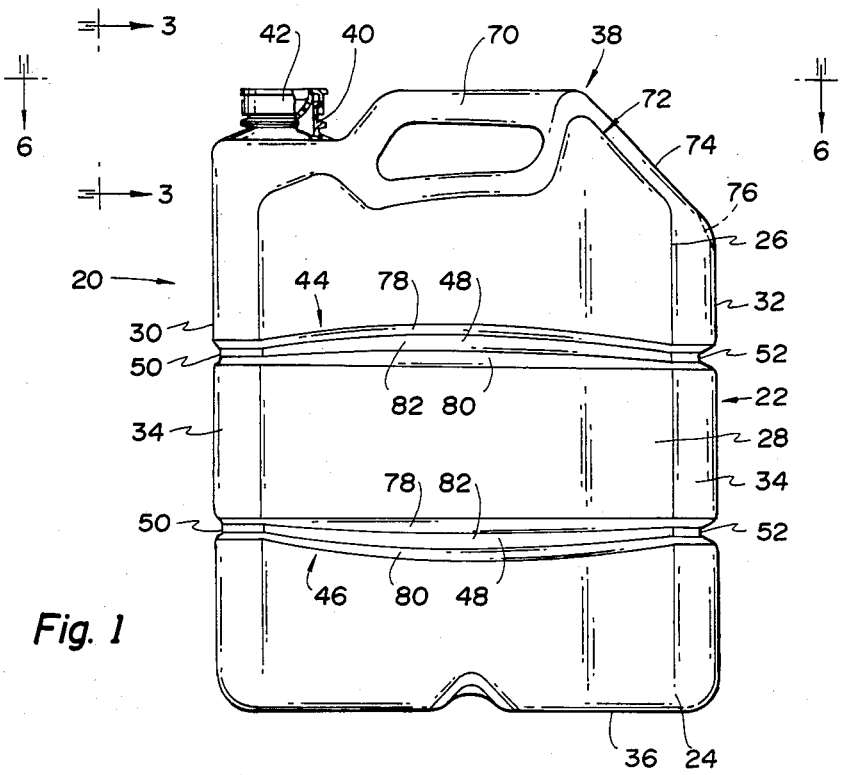
FIG. 1 is a side elevational view of a plastic blow molded container constructed in accordance with the present invention and shown in an upright position.

With reference to FIG. 1 of the drawings, a plastic blow molded container for liquids is constructed in accordance with the present invention and generally indicated by 20. As is hereinafter more fully described, container 20 has particular utility for use in dispensing water, especially distilled spring water used for drinking and cooking purposes.

Figure 2:
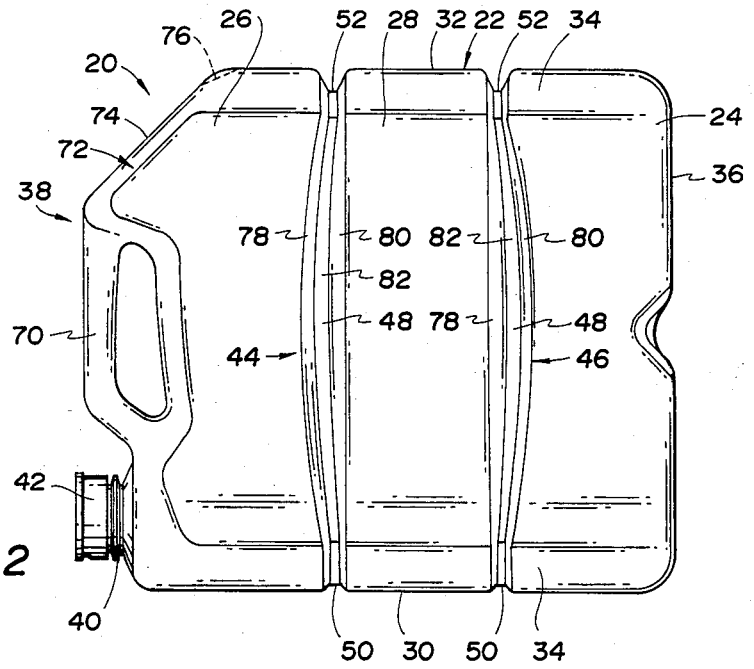
FIG. 2 is a side elevational view taken in the same direction as FIG. 1 but with the container shown positioned sideways for dispensing its liquid contents.
Figure 6:
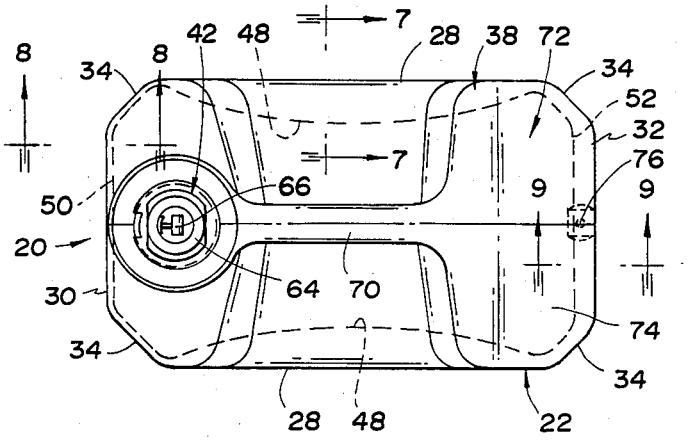
FIG. 6 is a top plan view of the container taken along the direction of line 6—6 in FIG. 1.

As illustrated in FIGS. 1, 2, and 6, a first pair of generally flat side walls 28 of the container extend between the bottom and top ends of the container body portion 22 and have the same size and shape as each other. A second pair of generally flat side walls 30 and 32 also extend between the bottom and top ends of the container body portion 22. The one pair of side walls 28 has a longer horizontal extent than the other pair of side walls 30 and 32 to provide the container body portion 22 with a horizontally elongated rectangular shape between its top and bottom ends as best illustrated in FIG. 6. This rectangular shape of the body portion 22 is disclosed as being provided with corner chamfers 34 to enhance the strength of the container. At its bottom end 24, the rectangular shape of the body portion 22 is closed by a bottom wall 36 illustrated in FIGS. 1 and 2.

With reference to FIGS. 1, 2, and 6, the container 20 includes a top closure 38 that closes the top end 26 of the container body portion 22. Top closure 38 has a dispensing spout 40 located adjacent the one shorter side wall 30 in a remote location from the shorter side wall 32. A unitary valve 42 is pressed onto the dispensing spout 40 to provide dispensing of liquid contents with the container supported on its one shorter side wall 30 as illustrated in FIG. 2.

Figure 7:
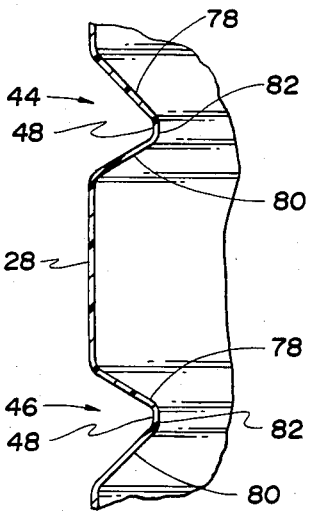
FIG. 7 is a partial sectional view taken along the direction of line 7—7 in FIG. 6 through a longer side wall of the container and illustrates the construction of rib portions thereof.
Figure 8:
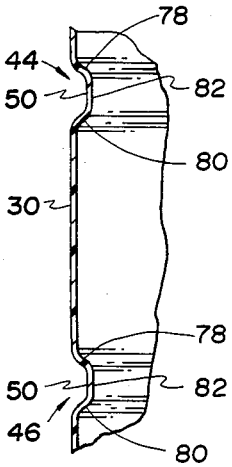
FIG. 8 is a partial sectional view taken along the direction of line 8—8 in FIG. 6 through one shorter side wall thereof adjacent the container dispensing spout and illustrates a relative shallow construction of rib portions thereof that permit pressing attachment of the unitary valve to the dispensing spout without undue compression of the side wall.
Figure 9:
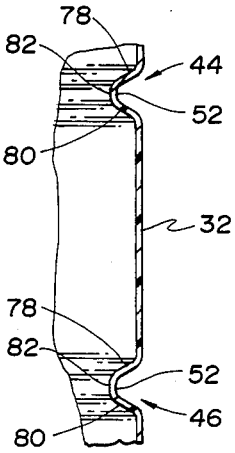
FIG. 9 is a partial sectional view taken along the direction of line 9—9 in FIG. 6 through the other shorter side wall of the container and illustrates the relatively deeper construction of rib portions thereof for maintaining the flatness of this side wall when the container is tipped sideways for dispensing.

Body portion 22 of the container includes at least one rib and preferably has upper and lower ribs 44 and 46 that extend completely around the body portion of the container projecting inwardly toward its interior. As shown in FIGS. 6 and 7, each of the ribs 44 and 46 includes curved rib portions 48 along the pair of longer side walls 28 to maintain the flatness thereof when the container is filled with liquid such as drinking water. As shown in FIGS. 1, 2, and 8, each rib 44 and 46 has a relatively shallow rib portion 50 along the one shorter side wall 30 that is adjacent the dispensing spout 40 to prevent excessive vertical compression of this side wall as the unitary valve 42 is pressed downwardly onto the dispensing spout. As shown in FIGS. 1, 2, and 9, each rib 44 and 46 also has a relatively deep rib portion 52 along the other shorter side wall 32 to maintain the flatness of this side wall with the filled container supported on the one shorter side wall 30 as shown in FIG. 2 for the liquid dispensing through the unitary valve 42.

In the specific example of the container disclosed, the longer side walls 28 have a horizontal length of about ten inches, the shorter side walls 30 and 32 have a horizontal length of about five and one-half inches, and the container has an overall height of about twelve inches to provide a liquid capacity of about two and one-half gallons. The maximum depth of the curved rib portions 48 is just slightly over $\frac{3}{4}$ of an inch, while the shallow rib portions 50 have a depth of just slightly less than $\frac{1}{8}$ and the deeper rib portions 52 have a depth that is just slightly over $\frac{1}{4}$ inch so as to be just slightly greater than twice the depth of the shallow rib portions. This ribbed container construction has particular utility for such relatively large sized containers designed to hold a plurality of gallons of liquid, Also, the terms "shallow" and "deep" rib portions as used herein are meant to define a relationship wherein the deep rib portion has a depth at least about twice the depth of the shallow rib portion.

Figure 3:
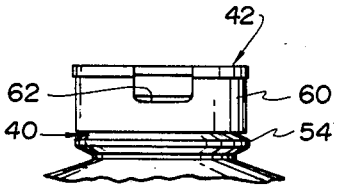
FIG. 3 is a partial elevational view taken along the direction of line 3—3 in FIG. 1 to illustrate a unitary valve of the container.
Figure 4:
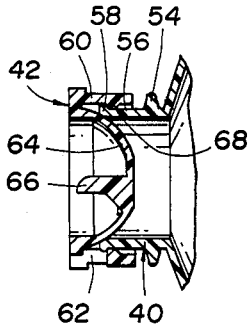
FIG. 4 is a partial sectional view taken in the same direction as FIG. 2 through a dispensing spout of the container and its attached unitary valve which is shown in a closed position.
Figure 5:
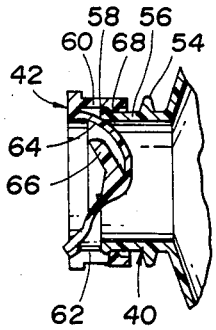
FIG. 5 is a partial sectional view similar to FIG. 4 but shown with the valve in an open position.

With reference to FIGS. 3 through 5, the dispensing spout 40 has a compacted construction formed during the blow molding and includes a lower flange 54 that may be continuous as illustrated or of an interrupted construction. This flange 54 can be used to provide container sensing and location in automated operations for filling the container and securing the unitary valve 42 onto the spout. An annular wall 56 (FIGS. 4 and 5) on the spout 40 projects upwardly from the lower flange 54 and has an upper extremity including an annular rib 58 that projects outwardly in order to secure the valve 42 in position.

As illustrated best in FIG. 3 through 6, the valve 42 is made from a suitable flexible plastic and includes an annular wall 60 that receives the annular wall 56 of the dispensing spout 40. An opening 62 is formed in the wall 60 as best illustrated in FIG. 3. At its upper end, the annular wall 60 is connected to a flexible closure wall 64 that normally projects into the spout wall 56 to seal against this wall adjacent the inner side of the spout rib 58. A projection 66 is supported on the closure wall 64 and is manually moved from the closed valve position of FIG. 4 to the open valve position of FIG. 5 in order to permit liquid contents to be dispensed by gravity through the opening 62. After the dispensing is completed, the projection 66 is manually released such that the normal shape of the closure wall 64 returns the valve to the closed position of FIG. 4. A rib 68 is provided on the inside of the valve wall 60 at the opposite end thereof as the end connected to the closure wall 64. This rib 68 extends inwardly and engages the outwardly extending rib 58 on the dispensing spout in order to secure the valve in position.

During assembly, the unitary valve 42 is pressed onto the dispensing spout 40 by downward movement thereof over the container 20. As this assembly takes place, the valve rib 68 is forced downwardly over the dispensing spout rib 58 which results in downward pressure that tends to vertically compress the container adjacent the one shorter side wall 30. This tendency to vertically compress the container is resisted by the one shorter side wall 30 and the shallow construction of the rib portions 50 thereof as previously described. Decreasing the degree to which the one shorter side wall 30 is compressed thus facilitates the assembly of the valve 42 by allowing an easier snap action assembly as the valve rib 68 snaps over the dispensing spout rib 58. Nevertheless, the other shorter side wall 32 is maintained flat in the use position of FIG. 2 without any tendency to curve as a result of the deeper construction of rib portions 52 previously described.

As illustrated in FIGS. 1, 2, and 6, the top closure 38 includes a central handle 70 located midway between the pair of longer side walls 28 and the pair of shorter side walls 30 and 32. The dispensing spout 40 is located on one side of the central handle 70 toward the one shorter side wall 30 with the shallow rib portions 50. Top closure 38 also has a vent hump 72 that supports the handle on the side thereof toward the other shorter side wall 32. The vent hump 72 has a label surface 74 that extends downwardly from the handle 70 at an inclination of about forty-five degrees. This construction provides a relatively large label area for identifying the liquid contents and information of the bottler or whatever else is necessary or desirable. The vent hump 72 also has a vent 76 (FIG. 6) at the lower extremity of the label surface 74. This vent 76 has a recessed construction including a projection that is cut to admit air into the container as its contents are dispensed. The location of the vent 76 as illustrated positions the vent at the upper extremity of the container in the dispensing position shown in FIG. 2 to thereby allow the admission of air into the container without any tendency to spill liquid.

It should be appreciated that it is preferably to have both upper and lower ribs 44 and 46 as illustrated. However, it is possible to utilize a single rib with the construction previously described in order to achieve the objective of the invention of preventing the one shorter side wall 30 from being compressed as the valve 42 is assembled while still maintaining the flatness of the other shorter side wall 32 during the liquid dispensing.

As illustrated in FIGS. 7 through 9, each rib 44 and 46 includes upper and lower inclined rib walls 78 and 80 that converge toward each other in an inward direction with respect to the interior of the container. Each rib 44 and 46 also includes a vertical connecting rib wall 82 that connects its inclined rib walls 78 and 80.

As shown in FIGS. 1 and 2, the upper inclined rib wall 78 of upper rib portion 48 and the lower inclined rib wall 80 of the lower rib portion 48 each have a curved shape, while the lower inclined rib wall 80 of upper rib portion 48 and the upper inclined rib wall 78 of lower rib portion 48 each have a flat shape. As illustrated in FIG. 7, such construction provides the upper inclined rib wall 78 of upper rib portion 48 with a steeper inclination than the adjacent lower rib wall 80 and also provides the lower inclined rib wall 80 of the lower rib portion 48 with a steeper inclination than the adjacent upper rib wall 78. This construction enhances the strength of the upper and lower ribs 44 and 46 along the pair of longer side walls 28.

The inclined rib walls 78 and 80 along the one shorter side wall 30 shown in FIG. 8 are shorter than the inclined rib walls 78 and 80 along the other shorter side wall 32 shown in FIG. 9. This difference in the extent of the inclined rib walls 78 and 80 along the two shorter side walls 30 and 32 provides the difference in the depths of the rib portions 50 and 52 in order to facilitate the valve assembly and maintain wall flatness as previously described.

While the best mode for carrying out the invention has been described in detail, those familiar with the art to which this invention relates will recognize various alternative designs and embodiments for practicing the invention as defined by the following claims.

What is claimed is:

1. A plastic blow molded container for holding liquids, comprising: a hollow body portion having bottom and top ends; said body portion having first and second pairs of generally flat side walls extending between the bottom and top ends of the body portion; one of said pairs of side walls having a longer horizontal extent than the other pair to provide the body portion with a horizontally elongated rectangular shape between its bottom and top ends; a bottom wall that closes the bottom end of the body portion; a top closure that closes the top end of the body portion has a central handle and also has a dispensing spout located adjacent one of the shorter side walls in a remote relationship to the other shorter side wall; a unitary valve that is pressed onto the dispensing spout to provide dispensing of liquid contents with the container supported on said one shorter side wall; at least one rib extending horizontally around the body portion of the container along each wall and projecting inwardly toward the interior of the body portion; said rib including curved rib portions along the pair of longer side walls to maintain the flatness thereof when the container is filled with liquid; said rib having a relatively shallow rib portion along the one shorter side wall adjacent to and on one side of the central handle and the dispensing spout to prevent excessive compression of the one shorter side wall as the unitary valve is pressed onto the dispensing spout; the rib having a relatively deep rib portion along the other shorter side wall on the opposite side of the central handle and dispensing spout from the shallow rib portion to maintain the flatness thereof with the filled container supported on the one shorter side wall for the liquid dispensing through the unitary valve; and the shallow and deep rib portions extending horizontally along the pair of shorter side walls of the body portion at the same elevation as each other.

2. A container as in claim 1 wherein the central handle is located midway between both pairs of side walls, the top closure having a vent hump that supports the handle on the side thereof toward the shorter side wall having the deeper rib, the vent hump having a label surface that extends downwardly from the handle at an inclination of about forty-five degrees, and the vent hump having a vent at the lower extremity of the label surface.

3. A container as in claim 1 or 2 wherein the body portion includes a pair of the ribs extending around the side walls thereof at upper and lower locations.

4. A container as in claim 3 wherein each rib includes inclined rib walls that converge toward each other in an inward direction, and each rib including a vertical connecting rib wall that connects its inclined rib wall.

5. A container as in claim 4 wherein the inclined rib walls along the shorter side wall adjacent the dispensing spout are shorter than the inclined rib walls along the other shorter side wall to thereby provide the difference in the depths of the rib portions along the pair of shorter side walls.

6. A plastic blow molded container for holding liquids, comprising: a hollow body portion having bottom and top ends; said body portion having first and second pairs of generally flat side walls extending between the bottom and top ends of the body portion; one of said pairs of side walls having a longer horizontal extent than the other pair to provide the body portion with a horizontally elongated rectangular shape between its bottom and top ends; a bottom wall that closes the bottom end of the body portion; a top closure that closes the top end of the body portion and has a central handle and also has a dispensing spout located adjacent one of the shorter side walls in a remote relationship to the other shorter side wall; a unitary valve that is pressed onto the dispensing spout to provide dispensing of liquid contents with the container supported on said one shorter side wall; upper and lower ribs extending horizontally around the body portion of the container along each wall and projecting inwardly toward the interior of the body portion; each rib including curved rib portions along the pair of longer side walls to maintain the flatness thereof when the container is filled with liquid; each rib having a relatively shallow rib portion along the one shorter side wall adjacent to and on one side of the central handle and the dispensing spout to prevent excessive compression of the one shorter side wall as the unitary valve is pressed onto the dispensing spout; each rib having a relatively deep rib portion along the other shorter side wall on the opposite side of the central handle and dispensing spout from the shallow rib portion to maintain the flatness thereof with the filled container supported on the one shorter side wall for the liquid dispensing through the unitary valve; and the shallow and deep rib portions extending horizontally along the pair of shorter side walls of the body portion at the same elevation as other other.

7. A plastic blow molded container for holding liquids, comprising: a hollow body portion having bottom and top ends; said body portion having first and second pairs of generally flat side walls extending between the bottom and top ends of the body portion; one of said pairs of side walls having a longer horizontal extent than the other pair to provide the body portion with a horizontally elongated rectangular shape between its bottom and top ends; a bottom wall that closes the top end of the body portion; a top closure that closes the top end of the body portion and has a central handle located midway between both pairs of side walls; the top closure having a dispensing spout located on one side of the handle adjacent one of the shorter side walls in a remote relationship to the other shorter side wall; a unitary valve that is pressed onto the dispensing spout to provide dispensing of liquid contents with the container supported on said one shorter side wall; the top closure also having a vent hump that supports the handle on the opposite side thereof as the dispensing spout; upper and lower ribs extending horizontally around the body portion of the container along each wall and projecting inwardly toward the interior of the body portion; each rib including curved rib portions along the pair of longer side walls to maintain the flatness thereof when the container is filled with liquid; each rib having a relatively shallow rib portion along the one shorter side wall adjacent to and on one side of the central handle and the dispensing spout to prevent excessive compression of the one shorter side wall as the unitary valve is pressed onto the dispensing spout; each rib having a relatively deep rib portion along the other shorter side wall on the opposite side of the central handle and dispensing spout from the shallow rib portion to maintain the flatness thereof with the filled container supported on the one shorter side wall for the liquid dispensing through the unitary valve; and the shallow and deep rib portions extending horizontally along the pair of shorter side walls of the body portion at the same elevation as each other.

8. A plastic blow molded container for holding liquids, comprising: a hollow body portion having bottom and top ends; said body portion having first and second pairs of generally flat side walls extending between the bottom and top ends of the body portion; one of said pairs of side walls having a longer horizontal extent than the other pair to provide the body portion with a horizontally elongated rectangular shape between its bottom and top ends; a bottom wall that closes the bottom end of the body portion; a top closure that closes the top end of the body portion and has a central handle located midway between both pairs of side walls; the top closure having a dispensing spout located on one side of the handle adjacent one of the shorter side walls in a remote relationship to the other shorter side wall; a unitary valve that is pressed onto the dispensing spout to provide dispensing of liquid contents with the container supported on said one shorter side wall; the top closure also having a vent hump that supports the handle on the opposite side thereof as the dispensing spout; the vent hump having a label surface that extends downwardly from the handle at an inclination of about forty-five degrees and has a lower extremity including a vent; upper and lower ribs extending horizontally around the body portion of the container along each wall and projecting inwardly toward the interior of the body portion; each rib including inclined rib walls that converge toward each other in an inward direction and also including a vertical connecting rib wall that connects its inclined rib walls; each rib including curved rib portions along the pair of longer side walls to maintain the flatness thereof when the container is filled with liquid; ech rib having a relatively shallow rib portion along the one shorter side wall adjacent to and on one side of the central handle and the dispensing spout to prevent excessive compression of the one shorter side wall as the unitary valve is pressed onto the dispensing spout; each rib having a relatively deep rib portion along the other shorter side wall adjacent the label surface on the opposite side of the central handle and dispensing spout from the shallow rib portion to maintain the flatness thereof with the filled container supported on the one shorter side wall for the liquid dispensing through the unitary valve; and the shallow and deep rib portions extending horizontally along the pair of shorter side walls of the body portion at the same elevation as each other.

* * * * *

UNITED STATES PATENT AND TRADEMARK OFFICE

CERTIFICATE OF CORRECTION

PATENT NO. : 4,733,804

DATED : March 29, 1988

INVENTOR(S) : Willaim A. Slat & Richard C. Darr

It is certified that error appears in the above-identified patent and that said Letters Patent is hereby corrected as shown below:

Column 3, Line 62, before "shorter side wall", insert --other--.

Column 4, Line 26, after "1/8" insert --inch--.

Column 4, Line 44, after "(Figures 4 and 5)" change "on" to --of--.

Column 4, Line 48, "Fig." should be --Figs.--.

Column 5, Line 43, "preferably" should be --preferable--.

Column 7, Line 2, Claim 4, after "rib", change "wall" to --walls--. (2nd occurr.)

Column 7, Line 44, Claim 6, after "elevation as", change "other" (first occurrence), to --each--.

Column 7, Line 53, Claim 7, "top" (2nd occurr.) should be --bottom--.

Column 8, Line 51, Claim 8, after "liquid;" change "ech' to --each--.

Signed and Sealed this

Twenty-first Day of March, 1989

*Attest:*

*Attesting Officer*

DONALD J. QUIGG

*Commissioner of Patents and Trademarks*